US006200944B1

(12) United States Patent
Dovey et al.

(10) Patent No.: US 6,200,944 B1
(45) Date of Patent: Mar. 13, 2001

(54) BLEACH PRECURSOR COMPOSITIONS

(75) Inventors: Anthony Dovey, Northumberland; Sanjeev Sharma, Newcastle upon Tyne, both of (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/202,878

(22) PCT Filed: Jun. 23, 1997

(86) PCT No.: PCT/US97/11068

§ 371 Date: Dec. 22, 1998

§ 102(e) Date: Dec. 22, 1998

(87) PCT Pub. No.: WO98/00504

PCT Pub. Date: Jan. 8, 1998

(30) Foreign Application Priority Data

Jun. 28, 1996 (EP) ..... 96304781

(51) Int. Cl.[7] ..... C11D 3/395

(52) U.S. Cl. ..... 510/313; 510/376; 510/349; 510/441; 252/186.26

(58) Field of Search ..... 252/186.25, 186.38, 252/186.26; 510/224, 312, 313, 376, 438, 444, 451, 349, 441

(56) References Cited

U.S. PATENT DOCUMENTS

| | | | | |
|---|---|---|---|---|
| 4,959,117 | | 9/1990 | De Leonibus et al. | 156/538 |
| 5,002,691 | | 3/1991 | Bolkan et al. | 252/186.25 |
| 5,534,195 | | 7/1996 | Chapman et al. | 510/444 |
| 5,703,030 | * | 12/1997 | Perkins et al. | 510/311 |
| 5,998,350 | * | 12/1999 | Burns et al. | 510/320 |

FOREIGN PATENT DOCUMENTS

| | | | | |
|---|---|---|---|---|
| 0 170 386 | | 5/1986 | (EP) | C11D/3/39 |
| 95/28473 | * | 10/1995 | (WO) . | |
| 96/16148 | * | 5/1996 | (WO) . | |

* cited by examiner

*Primary Examiner*—Caroline D. Liott
(74) *Attorney, Agent, or Firm*—C. Brant Cook; Kim W. Zerby

(57) ABSTRACT

A solid bleach precursor composition is provided comprising a bleach precursor and a surfactant system, whereby the composition exhibits effective solublisation of its bleach precursor component.

8 Claims, No Drawings

BLEACH PRECURSOR COMPOSITIONS

TECHNICAL FIELD OF THE INVENTION

The present invention relates to a bleach precursor composition and incorporation thereof in a detergent composition, whereby the precursor exhibits effective solubilisation properties.

BACKGROUND OF THE INVENTION

The satisfactory removal of soils/stains from soiled/stained substrates is a particular challenge to the formulator of a detergent composition for use in a washing method such as a laundry or machine dishwashing method.

Traditionally, the removal of such soils/stains has been enabled by the use of bleach components such as oxygen bleaches, including hydrogen peroxide and organic peroxyacids. The organic peroxyacids are often obtained by the in situ perhydrolysis reaction between hydrogen peroxide and an organic peroxyacid bleach precursor, so called "bleach precursor".

A problem encountered with the use of bleach precursors is that upon cold temperature washing solutions (5° C. to 30° C.) or under high water hardness conditions, the solubilisation rate of the precursors is decreased. As the perhydrolysis rate is reduced, so does the cleaning performance. Such a problem of low solubilisation or dissolution is further exarcerbated where the precursor exhibits surfactancy properties. Typical examples of such precursors are the amide substituted bleach precursor compounds such as (6-octanamido-caproyl) oxy benzene sulfonate, (6-nonanamidocaproyl) oxy benzene sulfonate and (6-decanamido-caproyl) oxy benzene sulfonate as described in EP-A-0170386. Accordingly, the formulator of a bleach precursor composition is faced with the challenge of formulating a bleach precursor composition which provides effective solubilisation or dissolution of the precursor.

To solve this problem of low dissolution, the coating and/or agglomeration of the bleach precursor with a water-soluble material has been proposed as described in co-pending application PCT/US95/15494.

However, notwithstanding the advances in the art, there is still a need for an alternative composition which provides effective dissolution of the bleach precursor.

The Applicant has now found that this problem can be overcome by the provision of a peroxyacid bleach precursor in combination with a surfactant system comprising a non-ethoxylated anionic surfactant and a nonionic surfactant.

SUMMARY OF THE INVENTION

The present invention encompasses a solid bleach precursor composition comprising:

a) a bleach precursor; and b) a surfactant system comprising a non-ethoxylated anionic surfactant and a nonionic surfactant;
wherein said surfactant system and said precursor are in close physical proximity.

It has to be understood by close physical proximity that the precursor and the surfactant system are not two separate discrete particles in the detergent composition.

For the purpose of the present invention, the term "close physical proximity" means one of the following:

i) an agglomerate, granule or extrudate in which said precursor and said surfactant system are in intimate admixture;

ii) a bleach precursor particulate coated with one or more layers wherein at least one layer contains one of the surfactant system component and the other is in intimate admixture with the bleach precursor component;

iii) a bleach precursor particulate comprising one of the surfactant system components, coated with one or more layers wherein at least one layer contains the bleach precursor in intimate admixture with the other surfactant system component.

iv) a bleach precursor particulate coated either with one or more layers wherein at least one layer contains both components of the surfactant system, or with at least two layers wherein at least one layer contains one of the surfactant system component and at least another layer contains the other surfactant system component;

v) a bleach precursor particulate comprising both components of the surfactant system coated with one or more layers wherein at least one layer contains the bleach activator.

In another embodiment of the invention, the present invention encompasses a detergent composition incorporating a solid bleach precursor composition as defined herein.

DETAILED DESCRIPTION OF THE INVENTION

Bleach Precursor

An essential component of the invention is a bleach precursor. Bleach precursors for inclusion in the composition in accordance with the invention typically contain one or more N- or O- acyl groups, which precursors can be selected from a wide range of classes. Suitable classes include anhydrides, esters, imides, nitriles and acylated derivatives of imidazoles and oximes, and examples of useful materials within these classes are disclosed in GB-A-t 586789.

Suitable esters are disclosed in GB-A-836988, 864798, 1147871, 2143231 and EP-A-0170386. The acylation products of sorbitol, glucose and all saccharides with benzoylating agents and acetylating agents are also suitable.

Specific O-acylated precursor compounds include nonanoyloxy benzene sulphonate, 3,5,5-tri-methyl hexanoyl oxybenzene sulfonates, benzoyl oxybenzene sulfonates, cationic derivatives of the benzoyl oxybenzene sulfonates, nonanoyl-6-amino caproyl oxybenzene sulfonates, monobenzoyltetraacetyl glucose and pentaacetyl glucose. Phtalic anhydride is a suitable anhydride type precursor. Useful N-acyl compounds are disclosed in GB-A-855735, 907356 and GB-A-1246338.

Preferred precursor compounds of the imide type include N-benzoyl succinimide, tetrabenzoyl ethylene diamine, N-benzoyl substituted ureas and the N,N-N'N' tetra acetylated alkylene diamines wherein the alkylene group contains from 1 to 6 carbon atoms, particularly those compounds in which the alkylene group contains 1, 2 and 6 carbon atoms. A most preferred precursor compound is N,N-N',N' tetra acetyl ethylene diamine (TAED).

N-acylated precursor compounds of the lactam class are disclosed generally in GB-A-955735. Whilst the broadest aspect of the invention contemplates the use of any lactam useful as a peroxyacid precursor, preferred materials comprise the caprolactams and valerolactams.

Suitable caprolactam bleach precursors are of the formula:

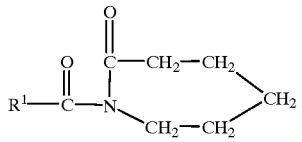

wherein $R^1$ is H or an alkyl, aryl, alkoxyaryl or alkaryl group containing from 1 to 12 carbon atoms, preferably from 6 to 12 carbon atoms.

Suitable valero lactams have the formula:

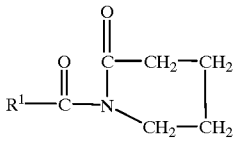

wherein $R^1$ is H or an alkyl, aryl, alkoxyaryl or alkaryl group containing from 1 to 12 carbon atoms, preferably from 6 to 12 carbon atoms. In highly preferred embodiments, $R^1$ is selected from phenyl, heptyl, octyl, nonyl, 2,4,4-trimethylpentyl, decenyl and mixtures thereof.

The most preferred materials are those which are normally solid at <30° C., particularly the phenyl derivatives, ie. benzoyl valerolactam, benzoyl caprolactam and their substituted benzoyl analogues such as chloro, amino, nitro, alkyl, alkyl, aryl and alkyoxy derivatives.

Caprolactam and valerolactam precursor materials wherein the $R^1$ moiety contains at least 6, preferably from 6 to about 12, carbon atoms provide peroxyacids on perhydrolysis of a hydrophobic character which afford nucleophilic and body soil clean-up. Precursor compounds wherein $R^1$ comprises from 1 to 6 carbon atoms provide hydrophilic bleaching species which are particularly efficient for bleaching beverage stains. Mixtures of 'hydrophobic' and 'hydrophilic' caprolactams and valero lactams, typically at weight ratios of 1:5 to 5:1, preferably 1:1, can be used herein for mixed stain removal benefits.

Another preferred class of bleach precursor materials include the cationic bleach activators, derived from the valerolactam and acyl caprolactam compounds, of formula:

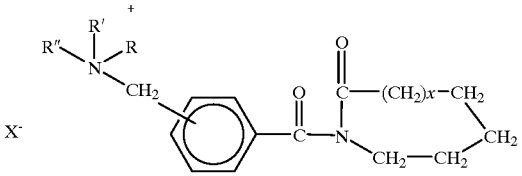

wherein x is 0 or 1, substituents R, R' and R" are each C1–C10 alkyl or C2–C4 hydroxy alkyl groups, or $[(C_yH_{2y})O]_n$—R'" wherein y=2–4, n=1–20 and R'" is a C1–C4 alkyl group or hydrogen and X is an anion.

Suitable imidazoles include N-benzoyl imidazole and N-benzoyl benzimidazole and other useful N-acyl group-containing peroxyacid precursors include N-benzoyl pyrrolidone, dibenzoyl taurine and benzoyl pyroglutamic acid.

Another preferred class of bleach precursor compounds are the amide substituted compounds of the following general formulae:

$R^1N(R^5)C(O)R^2C(O)L$ or $R^1C(O)N(R^5)R^2C(O)L$ wherein $R^1$ is an alkyl, alkylene, aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should preferably not contain more than 18 carbon atoms total. Preferred examples of bleach precursors of the above formulae include amide substituted peroxyacid precursor compounds selected from (6-octanamido-caproyl) oxybenzenesulfonate, (6-nonanamidocaproyl)oxy benzene sulfonate, (6-decanamido-caproyl)oxybenzenesulfonate, and mixtures thereof as described in EP-A-0170386.

Also suitable are precursor compounds of the benzoxazin-type, as disclosed for example in EP-A-332,294 and EP-A-482,807, particularly those having the formula:

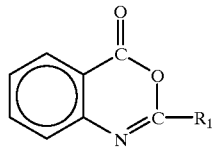

including the substituted benzoxazins of the type

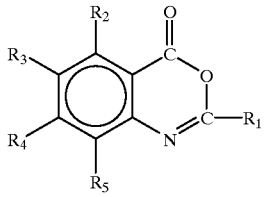

wherein $R_1$ is H, alkyl, alkaryl, aryl, arylalkyl, secondary or tertiary amines and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

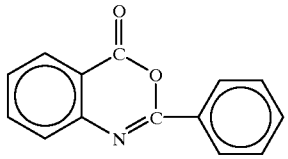

The bleach precursor components preferably have a particle size of from 250 micrometers to 2000 micrometers.

These bleach precursors can be partially replaced by preformed peracids such as N,N phthaloylaminoperoxy acid (PAP), nonyl amide of peroxyadipic acid (NAPAA), 1,2 diperoxydodecanedioic acid (DPDA) and trimethyl ammonium propenyl imidoperoxy mellitic acid (TAPIMA).

More preferred among the above described bleach precursors are nonanoyl oxy benzene sulphonate and/or the amide substituted bleach precursor compounds. Most preferably, the bleach precursors are the amide substituted bleach precursor compounds selected from (6-octanamidocaproyl)oxybenzenesulfonate, (6-nonanamidocaproyl)oxybenzene sulfonate, (6-decanamido-caproyl) oxybenzenesulfonate, and mixtures thereof.

The bleach precursors are normally incorporated at a level of from 20% to 95% preferably 50% to 90% by weight of the bleach precursor component and most preferably at least 60% by weight thereof.

Surfactant System

An essential feature of the invention is a surfactant system comprising a non-ethoxylated anionic surfactant and a nonionic surfactant. The surfactant system will typically be present in an amount of 0.1% to 50% by weight, more preferably in an amount of 1% to 20% by weight of the bleach precursor composition.

Non-ethoxylated Anionic Surfactant

Non-ethoxylated anionic surfactants, for use herein, include salts (including, for example, sodium, potassium, ammonium, and substituted ammonium salts such as mono-, di- and triethanolamine salts) of the anionic sulfate, sulfonate, carboxylate and sarcosinate surfactants.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic sulfate surfactants suitable for use herein include the linear and branched primary alkyl sulfates, fatty oleyl glycerol sulfates, the $C_5$–$C_{17}$ acyl—N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the group consisting of branched-chain and random C10–C20 alkyl sulphates ("AS"), the C10–C18 secondary (2,3) alkyl sulphates of the formula $CH_3(CH_2)_x(CHOSO_3^-M^+)$ $CH_3$ and $CH_3(CH_2)_y(CHOSO_3^-M^+)$ $CH_2CH_3$ where x and (y+1) are integers of at least 7, preferably at least about 9, and M is a water-solubilising cation, especially sodium, unsaturated sulphates such as oleyl sulphate.

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic carboxylate surfactants suitable for use herein include the soaps ('alkyl carboxyls'), especially certain secondary soaps as described herein.

Preferred soap surfactants are secondary soap surfactants which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants should preferably contain no ether linkages, no ester linkages and no hydroxyl groups. There should preferably be no nitrogen atoms in the head-group (amphiphilic portion). The secondary soap surfactants usually contain 11–15 total carbon atoms, although slightly more (e.g., up to 16) can be tolerated, e.g. p-octyl benzoic acid.

The following general structures further illustrate some of the preferred secondary soap surfactants:

A. A highly preferred class of secondary soaps comprises the secondary carboxyl materials of the formula $R^3CH(R^4)COOM$, wherein $R^3$ is $CH_3(CH_2)x$ and $R^4$ is $CH_3(CH_2)y$, wherein y can be 0 or an integer from 1 to 4, x is an integer from 4 to 10 and the sum of (x+y) is 6–10, preferably 7–9, most preferably 8.

B. Another preferred class of secondary soaps comprises those carboxyl compounds wherein the carboxyl substituent is on a ring hydrocarbyl unit, i.e., secondary soaps of the formula $R^5$–$R^6$–COOM, wherein $R^5$ is $C^7$–$C^{10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

C. Still another preferred class of secondary soaps comprises secondary carboxyl compounds of the formula $$CH_3(CHR)_k—(CH_2)_m—(CHR)_n—CH(COOM)(CHR)_o—(CH2)_p—(CHR)_q—CH_3,$$

wherein each R is $C_1$–$C_4$ alkyl, wherein k, n, o, q are integers in the range of 0–8, provided that the total number of carbon atoms (including the carboxylate) is in the range of 10 to 18.

In each of the above formulas A, B and C, the species M can be any suitable, especially water-solubilizing, counterion.

Especially preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Other suitable anionic surfactants are the alkali metal sarcosinates of formula R-CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleyl methyl sarcosinates in the form of their sodium salts.

Among the above described non-ethoxylated anionic surfactants, the anionic sulfate surfactants, anionic sulfonate surfactants, or mixtures thereof are preferred. More preferably, the anionic surfactant is selected from $C_{12}$–$C_{18}$ linear alkyl sulphates, $C_5$–$C_{20}$ linear alkylbenzene sulfonates and mixtures thereof, and most preferably is the salt of $C_5$–$C_{20}$ linear alkylbenzene sulfonate.

Preferably the anionic surfactant is present in an amount of from 0.1% to 49.9% by weight, more preferably from 1% to 19% by weight of the bleach precursor composition.

Nonionic Surfactant

Nonionic surfactants, for use herein, include the polyhydroxy fatty acid amide surfactants, condensates of alkyl phenols, ethoxylated alcohol surfactants, ethoxylated/propoxylated fatty alcohol surfactant, ethylene oxide/propylene oxide condensates with propylene glycol, ethylene oxide condensation products with propylene oxide/ethylene diamine adducts, alkylpolysaccharide surfactants, fatty acid amide surfactants and mixtures thereof. Exemplary, non-limiting classes of useful nonionic surfactants are listed below.

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide.

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

As ethoxylated/propoxylated fatty alcohol surfactants, the ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably, the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

The preferred alkylpolyglycosides have the formula $$R^2O(C_nH_{2n}O)t(\text{glycosyl})_x$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3; t is from 0 to 10, preferably O, and X is from 1.3 to 8, preferably from 1.3 to 3, most preferably from 1.3 to 2.7. The glycosyl is preferably derived from glucose.

Fatty acid amide surfactants suitable for use herein are those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Preferred among the above described nonionic surfactants are the ethoxylated surfactants preferably selected from ethoxylated alcohol surfactants, ethoxylated/propoxylated fatty alcohol surfactant, ethylene oxide/propylene oxide condensates with propylene glycol, ethylene oxide condensation products with propylene oxide/ethylene diamine adducts and mixtures thereof, more preferably the ethoxylated alcohol surfactants.

Most preferred ethoxylated alcohol surfactants are the condensation products of alcohols having an alkyl group containing from 8 to 20 carbon atoms with from 2 to 10 moles of ethylene oxide per mole of alcohol, in particular the linear primary alcohol (C12/C14) condensed with an average of 3 moles of ethylene oxide .

Preferably the nonionic surfactant is present in an amount of 0.01% to 20% by weight, more preferably from 0.1% to 5% by weight of the bleach precursor composition.

Optionals

Optional components may be present within the bleach precursor composition. Suitable optionals for use herein include hydrotropes components, acids, binding agents, additional surface active agents such as cationic surfactants, and mixtures thereof.

Hydrotropes are particularly useful as optional components of the bleach precursor composition in that they surprisingly aid the solubilisation of the bleach precursor composition. When used, hydrotropes will typically be present in an amount of 0.1% to 20%, preferably from 0.5% to 10% by weight of the bleach precursor composition.

Optional hydrotropes suitable for use herein are selected from the group of lower alkyl aryl sulphonate salts, $C_6$–$C_{12}$ alkanols, $C_1$–$C_6$ carboxylic sulphate or sulphonate salts, urea, $C_1$–$C_4$ hydrocarboxylates, $C_1$–$C_4$ carboxylates and $C_2$–$C_4$ diacids and mixtures thereof.

Suitable lower alkyl aryl sulphonates are preferably $C_7$–$C_9$ alkyl aryl sulphonates and include sodium, potassium, calcium and ammonium xylene sulphonates, sodium, potassium, calcium and ammonium toluene sulphonates, sodium, potassium, calcium and ammonium cumene sulphonate, and sodium, potassium, calcium and ammonium napthalene sulphonates and mixtures thereof.

Suitable $C_1$–$C_8$ carboxylic sulphate or sulphonate salts are any water soluble salts or organic compounds comprising 1 to 8 carbon atoms (exclusive of substituent groups), which are substituted with sulphate or sulphonate and have at least one carboxylic group. The substituted organic compound maybe cyclic, acylic or aromatic, i.e. benzene derivatives. Preferred alkyl compounds have from 1 to 4 carbon atoms substituted with sulphate or sulphonate and have from 1 to 2 carboxylic groups. Examples of suitable hydrotropes include sulphosuccinate salts, sulphophthalic salts, sulphoacetic salts, m-sulphobenzoic acid salts and diesters sulphosuccinates, preferably the sodium or potassium salts as disclosed in U.S. Pat. No. 3,915,903.

Suitable $C_1$–$C_4$ hydrocarboxylates, $C_1$–$C_4$ carboxylates for use herein include acetates and propionates and citrates. Suitable $C_2$–$C_4$ diacids for use herein include succinic, glutaric and adipic acids.

Other compounds which deliver hydrotropic effects suitable for use herein as a hydrotrope include $C_6$–$C_{12}$ alkanols and urea.

Preferred hydrotropes for use herein are selected from the salts of cumene sulphonate, xylene sulphonate, toluene sulphonate and mixtures thereof. The salts suitable for use herein are sodium, potassium, calcium and ammonium. Most preferred are sodium toluene sulphonate.

Acids may also be useful in the composition of the present invention in particular as stabilising agents. Typical levels of such acids are from 0.1 to 40% by weight, preferably from 1% to 20% by weight of the bleach precursor composition. Suitable acids are preferably water-soluble such as fatty acids, glycolic acid, glutaric acid, citric acid and polymeric carboxylic acids.

Optionally, binding agents may be used in the composition of the present invention. Typical levels of such binding agents are from 0.01% to 20% by weight, preferably from 0.5% to 10% by weight of the bleach precursor composition. Suitable binding agents include starch, cellulose and cellulose derivatives (e.g. sodium carboxymethyl cellulose), sugar and film-forming polymers such as polymeric carboxylic acid, including copolymers, polyvinyl pyrrolidone, polyvinyl acetate. Cellulose and cellulose derivatives (e.g. sodium carboxymethyl cellulose) are particularly preferred.

Form of The Bleach Precursor Composition

The surfactant system and the bleach precursor of the solid bleach precursor composition are in close physical proximity.

It has to be understood by close physical proximity that the precursor and the surfactant system are not two separate discrete particles in the detergent composition.

For the purpose of the present invention, the term "close physical proximity" means one of the following:

i) an agglomerate, granule or extrudate in which said precursor and said surfactant system are in intimate admixture;

ii) a bleach precursor particulate coated with one or more layers wherein at least one layer contains one of the surfactant system component and the other is in intimate admixture with the bleach precursor component;

iii) a bleach precursor particulate comprising one of the surfactant system component, coated with one or more layers wherein at least one layer contains the bleach precursor in intimate admixture with the other surfactant system component.

iv) a bleach precursor particulate coated either with on e or more layers wherein at least one layer contains both components of the surfactant system, or with at least two layers wherein at least one layer contains one of the surfactant system components and at least another layer contains the other surfactant system component;

v) a bleach precursor particulate comprising both components of the surfactant system coated with one or more layers wherein at least one layer contains the bleach activator. Preferably, the bleach precursor composition may be in any known suitable particulate form for incorporation in a detergent composition, such as an agglomerate, granule, extrudate or spheronised extrudate. Preferably, the bleach precursor composition is in a form of a spheronised extrudate.

A preferred process for the manufacture of the bleach precursor spheronised extrudate comprises the steps of:

(i) preparing a mix of solids, and optionally liquids, comprising the bleach activator;

(ii) extruding the mix through a die under pressure to form an extrudate;

(iii) breaking the extrudate to form a spheronised extrudate; and (iv) optionally coating the particles to improve friability and flow characteristics.

The mixing step (i) is carried out using any conventional powder/liquid mixer, e.g. a Loedige KM mixer. The extruding step (ii) can be achieved using any conventional extruder which can be axial, radial or more preferably dome-type, e.g. Fuji Paudal Model DGL-1, most preferably having a die with <0.1 mm orifices and extruded at pressures of about 20 bar. Step (iii) is preferably carried out using a rotating disc spheroniser such as a Fuji Paudal QJ-1000 where the extrudates are broken down into short lengths and formed into substantially spherical particles.

Additionally, the extrudates may then be dried in a vibrating fluid bed drier, e.g. Niro, to result in crisp, free-flowing particles with a particle size range of from 0.25 mm to 20 mm and a Heubach dust measurement of less than 100 mg/g.

The optional coating step (iv) could involve materials such as film forming polymers or preferably a liquid fixative, e.g. nonionic surfactant and an inert powder such as Zeolite A.

By effective solubilisation rate is meant that the use of a composition comprising the bleach precursor and the surfactant system as described above provides a better solubilisation of the bleach precursor properties than the use of the same composition without the surfactant system. The peroxyacid bleach precursor particulates may suitably be incorporated in detergent compositions. Detergent compositions incorporating the peroxy acid bleach precursor particulates will normally contain from 1% to 20% of the precursor particulates, more frequently from 1% to 10% and most preferably from 1% to 7%, on a composition weight basis.

Such detergent compositions will, of course, contain a source of alkaline hydrogen peroxide necessary to form a peroxyacid bleaching species in the wash solution and preferably will also contain other components conventional in detergent compositions.

Detergent compositions incorporating the particulate peroxyacid precursors of the present invention will include a hydrogen peroxide or a source thereof. Preferred sources of hydrogen peroxide include an inorganic perhydrate bleach, normally in the form of the sodium salt, as the source of alkaline hydrogen peroxide in the wash liquor. This perhydrate is normally incorporated at a level of from 3% to 40% by weight, more preferably from 5% to 35% by weight and most preferably from 8% to 30% by weight of the composition.

The perhydrate may be any of the alkali metal inorganic salts such as perborate monohydrate or tetrahydrate, percarbonate, perphosphate and persilicate salts but is conventionally an alkali metal perborate or percarbonate.

Sodium percarbonate, which is the preferred perhydrate, is an addition compound having a formula corresponding to $2Na_2CO_3.3H_2O_2$, and is available commercially as a crystalline solid. Most commercially available material includes a low level of a heavy metal sequestrant such as EDTA, 1-hydroxyethylidene 1,1-diphosphonic acid (HEDP) or an amino-phosphonate, that is incorporated during the manufacturing process. For the purposes of the detergent composition aspect of the present invention, the percarbonate can be incorporated into detergent compositions without additional protection, but preferred executions of such compositions utilise a coated form of the material. A variety of coatings can be used including borate, boric acid and citrate or sodium silicate of $SiO_2$:$Na_2O$ ratio from 1.6:1 to 3.4:1, preferably 2.8:1, applied as an aqueous solution to give a level of from 2% to 10%, (normally from 3% to 5%) of silicate solids by weight of the percarbonate. However, the most preferred coating is a mixture of sodium carbonate and sulphate or sodium chloride.

The particle size range of the crystalline percarbonate is from 350 micrometers to 1500 micrometers with a mean of approximately 500–1000 micrometers.

The detergent composition, in addition to the bleach precursor particulate and the hydrogen peroxide or source thereof, may also contain additional components. The precise nature of these additional components and levels of incorporation thereof will depend on the physical form of the composition, and the nature of the cleaning operation for which it is to be used. The compositions of the invention may, for example, be formulated as hand and machine laundry detergent compositions, including laundry additive compositions and compositions suitable for use in the pretreatment of stained fabrics and machine dishwashing compositions. When incorporated in compositions suitable for use in a machine washing method, e.g.: machine laundry and machine dishwashing methods, the compositions of the invention preferably contain one or more additional detersive components.

Thus preferred detergent compositions will incorporate one of more of surfactants, builders, chelating agents, enzymes, soil suspending and anti-redeposition agents, suds suppressors, fluorescent whitening agents photo activated bleaches, perfumes and colours.

Surfactants

A wide range of surfactants can be used in the detergent compositions, A typical listing of anionic, nonionic, ampholytic and zwitterionic classes, and species of these surfactants, is given in U.S. Pat. No. 3,929,678 issued to Laughlin and Heuring on Dec., 30, 1975. A list of suitable cationic surfactants is given in U.S. Pat. No. 4,259,217 issued to Murphy on Mar. 31, 1981.

Nonlimiting examples of surfactants useful herein at levels from 1% to 55%, by w eight, typically include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least 7, preferably at least 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_8$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N (3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Other suitable surfactants suitable for the purpose of the invention are the anionic alkali metal sarcosinates of formula:

$$R—CON(R^1)CH_2COOM$$

wherein R is a $C_9$–$C_{17}$ linear or branched alkyl or alkenyl group, $R^1$ is a $C_1$–$C_4$ alkyl group and N is an alkali metal ion. Preferred examples are the lauroyl, cocoyl ($C_{12}$–$C_{14}$), myristyl and oleyl methyl sarcosinates in the form of their sodium salts. Cationic surfactants can also be used in the compositions herein. Suitable cationic surfactants include the quaternary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Mixtures of anionic and nonionic surfactants are especially useful. Other conventional useful surfactants are listed in standard texts.

Builders

Detergent builders can optionally be included in the compositions herein to assist in controlling mineral hardness. Inorganic as well as organic builder s can be used. Builders are typically used in fabric laundering compositions to assist in the removal of particulate soils. The level of builder can vary widely depending upon the end use of the composition and its desired physical form. When present, the compositions will typically comprise at least 1% builder. Granular formulations typically comprise from 10% to 80%, more typically from 15% to 50% by weight, of the detergent builder. Lower or higher levels of builder, however, are not meant to be excluded.

Inorganic or phosphate-containing detergent builders include, but are not limited to, the alkali metal, ammonium and alkanolammonium salts of polyphosphates (exemplified by the tripolyphosphates, pyrophosphates, and glassy polymeric meta-phosphates).

Non-phosphate builders may also be used. These can include, but are not restricted to phytic acid, silicates, alkali metal carbonates (including bicarbonates and sesquicarbonates), sulphates, aluminosilicates, monomeric polycarboxylates, homo or copolymeric polycarboxylic acids or their salts in which the polycarboxylic acid comprises at least two carboxylic radicals separated from each other by not more than two carbon atoms, organic phosphonates and aminoalkylene poly (alkylene phosphonates). The compositions herein also function well in the presence of the so-called "weak" builders (as compared with phosphates) such as citrate, or in the so-called "underbuilt" situation that may occur with zeolite or layered silicate builders.

Examples of silicate builders are the so called 'amorphous' alkali metal silicates, particularly those having a $SiO_2$:$Na_2O$ ratio in the range 1.6:1 to 3.2:1 and crystalline layered silicates, such as the layered sodium silicates described in U.S. Pat. No. 4,664,839. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2Si_2O_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2Si_2O_5$ (NaSKS-6 form) is most preferred for use herein. Other silicates may also be useful such as for example magnesium silicate, which can serve as a crispening agent in granular formulations, as a stabilising agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are of great importance in most currently marketed heavy duty granular detergent compositions, and can also be a significant builder ingredient in liquid detergent formulations. Aluminosilicate builders include those having the empirical formula:

$$Na_z[(AlO_2)_z(SiO_2)_y].xH_2O$$

wherein z and y are integers of at least 6, the molar ratio of z to y is in the range from 1.0 to 0.5, and x is an integer from 15 to 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from 20 to 30, especially 27. This material is known as Zeolite A. Dehydrated zeolites (x=0–10) may also be used herein. Preferably, the aluminosilicate has a particle size of 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralised salt. When utilized in salt form, alkali metals, such as sodium, potassium, and lithium, or alkanolammonium salts are preferred. Included among the polycarboxylate builders are a variety of categories of useful materials. One important category of polycarboxylate builders encompasses the ether polycarboxylates, including oxydisuccinate, as disclosed in U.S. Pat. No. 3,128,287 and U.S. Pat. No. 3,635,830. See also "TMS/TDS" builders of U.S. Pat. No. 4,663,071. Suitable ether polycarboxylates also include cyclic compounds, particularly alicyclic compounds, such as those described in U.S. Pat. Nos. 3,923,679; 3,835,163; 4,158,635; 4,120,874 and 4,102,903. Other useful detergency builders include the ether hydroxypolycarboxylates, copolymers of maleic anhydride with ethylene or vinyl methyl ether, or acrylic acid, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the compositions containing the present invention are the 3,3-dicarboxy-4-oxa-1,6-hexanedioates and the related compounds disclosed in U.S. Pat. No. 4,566,984. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinate s are the preferred builders of this group, and are described in EP 0,200,263. Other suitable polycarboxylates are disclosed in U.S. Pat. No. 4,144,226 and in U.S. Pat. No. 3,308,067. See also U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Chelating Agents

The detergent compositions here in may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraamine-hexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates) as DEQUEST and hydroxyethane 1,1 diphosphonic acid (HEDP). Preferred, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

Preferred biodegradable chelating agents for use herein are ethylenediamine disuccinate ("EDDS"), especially the [S,S] isomer and/or hydroxy-ethane 1,1 diphosphonic acid (HEDP).

The compositions herein may also contain water-soluble methyl glycine diacetic acid (MGDA) salts (or acid form) as a chelant or co-builder useful with, for example, insoluble builders such as zeolites, layered silicates and the like.

If utilized, these chelating agents will generally comprise from about 0.1% to about 15% by weight of the detergent compositions herein.

More preferably, if utilized, the chelating agents will comprise from about 0.1% to about 3.0% by weight of such compositions.

Enzymes

Enzymes can be included in the present detergent compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. "Detersive enzyme", as used herein, means any enzyme having a cleaning, stain removing or otherwise beneficial effect in a laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred for automatic dishwashing are amylases and/or proteases, including both current commercially available types and improved types which, though more and more bleach compatible through successive improvements, have a remaining degree of bleach deactivation susceptibility.

Enzymes are normally incorporated into detergent compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniformis*. One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands; as well as Protease A as disclosed in EP 130,756 and Protease B as disclosed in EP 303,761 and EP 130,756. See also a high pH protease from Bacillus sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble. When desired, a protease having decreased adsorption and increased hydrolysis is available as described in WO 9507791 to Procter & Gamble. A recombinant trypsin-like protease for detergents suitable herein is described in WO 9425583 to Novo. In more detail, an especially preferred protease, referred to as "Protease D" is described in the patent applications of A. Baeck, et al, entitled "Protease–Containing Cleaning Compositions" having U.S. Ser. No. 08/322,676, and C. Ghosh, et al, "Bleaching Compositions Comprising Protease Enzymes" having U.S. Ser. No. 08/322,677, both filed Oct. 13, 1994.

Amylases suitable herein, include, for example, α-amylases described in GB 1,296,839 to Novo; RAPIDASE®, International Bio-Synthetics, Inc. and TERMAMYL®, Novo. FUNGAMYL® from Novo is especially useful.

Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Bacillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis*, or *B. stearothermophilus*; (b) stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B licheniformis* NCIBB061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability-enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Other amylase enzymes include those described in WO 95/26397 and in co-pending application by Novo Nordisk PCTIDK96/00056. Specific amylase enzymes for use in the detergent compositions of the present invention include α-amylases characterized by having a specific activity at least 25% higher than the specific activity of Termamyl® at a temperature range of 25° C. to 55° C. and at a pH value in the range of 8 to 10, measured by the Phadebas® α-amylase activity assay. (Such Phadebas® α-amylase activity assay is described at pages 9–10, WO 95/26397.) Also included herein are α-amylases which are at least 80% homologous with the amino acid sequences shown in the SEQ ID listings in the references. These enzymes are preferably incorporated into laundry detergent compositions at a level from 0.00018% to 0.060% pure enzyme by weight of the total composition, more preferably from 0.00024% to 0.048% pure enzyme by weight of the total composition. Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, *Dolabella Auricula Solander*. Suitable cellulases are also disclosed in GB-A-2.075.028; GB-A-2.095.275 and DE-OS-2.247.832. CAREZYME® and CELLUZYME® (Novo) are especially useful. See also WO 9117243 to Novo.

Suitable lipase enzymes for detergent usage include those produced by microorganisms of the Pseudomonas group, such as *Pseudomonas stutzeri* ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano–CES, lipases ex *Chromobacter viscosum*, e.g. *Chromobacter viscosum var. lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044. In spite of the large number of publications on lipase enzymes, only the lipase derived from *Humicola lanuginosa* and produced in *Aspergillus oryzae* as host has so far found widespread application as additive for fabric washing products. It is available from Novo Nordisk under the tradename Lipolase™, as noted above. In order to optimize the stain removal performance of Lipolase, Novo Nordisk have made a number of variants. As described in WO 92/05249, the D96L variant of the native *Humicola lanuginosa* lipase improves the lard stain removal efficiency by a factor 4.4 over the wild-type lipase (enzymes compared in an amount ranging from 0.075 to 2.5 mg protein per liter). Research Disclosure No. 35944 published on Mar. 10, 1994, by Novo Nordisk discloses that the lipase variant (D96L) may be added in an amount corresponding to 0.001–100-mg (5–500,000 LU/liter) lipase variant per liter of wash liquor. Cutinase enzymes suitable for use herein are described in WO 8809367 A to Genencor.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase. Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilised by various techniques. Enzyme stabilisation techniques are disclosed and exemplified in U.S. Pat. No. 3,600,319, Aug. 17, 1971, Gedge et al, EP 199,405 and EP 200,586, Oct. 29, 1986, Venegas. Enzyme stabilisation systems are also described, for example, in U.S. Pat. No. 3,519,570. A useful Bacillus, sp. AC13 giving proteases, xylanases and cellulases, is described in WO 9401532 A to Novo.

Polymeric DisDersing Agents

Polymeric dispersing agents can be utilized at levels from 0.5% to 8%, by weight, in the compositions herein, especially in the presence of zeolite and/or layered silicate builders. Suitable polymeric dispersing agents include polymeric polycarboxylates and polyethylene glycols, although others known in the art can also be used.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates are selected from acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than 40% by weight. Polymeric polycarboxyiate materials can also optionally include further monomeric units such as nonionic spacing units. For example, suitable nonionic spacing units may include vinyl alcohol or vinyl acetate.

Particularly preferred polymeric polycarboxylates are co-polymers derived from monomers of acrylic acid and maleic acid. The average molecular weight of such polymers in the acid form preferably ranges from 2,000 to 10,000, more preferably from 4,000 to 7,000 and most preferably from 4,000 to 5,000. Water-soluble salts of such acrylic/maleic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967. The ratio of acrylate to maleate segments in such copolymers will generally range from 30:1 to 1:1, more preferably from 10:1 to 2:1. Soluble acrylate/maleate copolymers of this type are known materials which are described in EP 66915 as well as in EP 193,360, which also describes such polymers comprising hydroxypropylacrylate. Of these acrylic/maleic-based copolymers, the water-soluble salts of copolymers of acrylic acid and maleic acid are preferred.

Another class of polymeric polycarboxylic acid compounds suitable for use herein are the homo-polymeric polycarboxylic acid compounds derived from acrylic acid. The average molecular weight of such homo-polymers in the acid form preferably ranges from 2,000 to 100,000, more preferably from 3,000 to 75,000, most preferably from 4,000 to 65,000.

A further example of polymeric polycarboxylic compounds which may be used herein include the maleic/acrylic/vinyl alcohol terpolymers. Such materials are also disclosed in EP 193,360, including, for example, the 45/45/10 terpolymer of acrylic/maleic/vinyl alcohol.

Another example of polymeric polycarboxylic compounds which may be used herein include the biodegradable polyaspartic acid and polyglutamic acid compounds.

Suds Suppressors

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347. The monocarboxylic fatty acids and salts thereof used as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyidiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. It is also known to utilize waxy hydrocarbons, preferably having a melting point below 100° C. The hydrocarbons constitute a preferred category of suds suppressor for detergent compositions. Hydrocarbon suds suppressors are described, for example, in U.S. Pat. No. 4,265,779. The hydrocarbons, thus, include aliphatic, alicyclic, aromatic, and heterocyclic saturated or unsaturated hydrocarbons having from 12 to 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779 and EP 354016.

Other silicone suds suppressors are disclosed in U.S. Pat. No. 3,455,839 which relates to compositions and processes for defoaming aqueous solutions by incorporating therein small amounts of polydimethylsiloxane fluids. Mixtures of silicone and silanated silica are described, for instance, in German Patent Application DOS 2,124,526. Silicone defoamers and suds controlling agents in granular detergent compositions are disclosed in U.S. Pat. No. 3,933,672 and in U.S. Pat. No. 4,652,392.

An exemplary silicone based suds suppressor for use herein is a suds suppressing amount of a suds controlling agent consisting essentially of:

(i) polydimethylsiloxane fluid having a viscosity of from 20 cs. to 1,500 cs. at 25° C.;

(ii) from 5 to 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from 0.6:1 to 1.2:1; and (iii) from 1 to 20 parts per 100 parts by weight of (i) of a solid silica gel.

In the preferred silicone suds suppressor used herein, the solvent for a continuous phase is made up of certain polyethylene glycols or polyethylene-poiypropylene glycol copolymers or mixtures thereof (preferred), or polypropylene glycol. The primary silicone suds suppressor is branched/crosslinked and preferably not linear.

The silicone suds suppressor herein preferably comprises polyethylene glycol and a copolymer of polyethylene glycol/polypropylene glycol, all having an average molecular weight of less than 1,000, preferably between 100 and 800. The polyethylene glycol and polyethylene/polypropylene copolymers herein have a solubility in water at room temperature of more than 2 weight %, preferably more than 5 weight %.

The preferred solvent herein is polyethylene glycol having an average molecular weight of less than 1,000, more preferably between 100 and 800, most preferably between 200 and 400, and a copolymer of polyethylene glycol/polypropylene glycol, preferably PPG 200/PEG 300. Preferred is a weight ratio of between 1:1 and 1:1 0, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount". By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to 5% of suds suppressor. When utilized as suds suppressors, monocarboxylic fatty acids, and salts therein, will be present typically in amounts up to 5%, by weight, of the detergent composition. Preferably, from 0.5% to 3% of fatty monocarboxylate suds suppressor is utilized. Silicone suds suppressors are typically utilized in amounts up to 2.0%, by weight, of the detergent composition, although higher amounts may be used. This upper limit is practical in nature, due primarily to concern with keeping costs minimized and effectiveness of lower amounts for effectively controlling sudsing. Preferably from 0.01% to 1% of silicone suds suppressor is used, more preferably from 0.25% to 0.5%. As used herein, these weight percentage values include any silica that may be utilized in combination with polyorganosiloxane, as well as any adjunct materials that may be utilized. Monostearyl phosphate suds suppressors are generally utilized in amounts ranging from 0.1% to 2%, by weight, of the composition. Hydrocarbon suds suppressors are typically utilized in amounts ranging from 0.01% to 5.0%, although higher levels can be used. The alcohol suds suppressors are typically used at 0.2%–3% by weight of the finished compositions.

Polymeric Soil Release Agent

Polymeric soil release agents are characterised by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkyiene units comprising oxyethylene and from 1 to 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least 25% oxyethylene units and more preferably, especially for such components having 20 to 30 oxypropylene units, at least 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b). Typically, the polyoxyethylene segments of (a)(i) will have a degree of polymerization of from 200, although higher levels can be used, preferably from 3 to 150, more preferably from 6 to 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow) and carboxy alkyl of cellulose such as Metolose (Shin Etsu). Cellulosic soil release agents for use herein also include those selected from $C_1$–$C_4$ alkyl and $C_4$ hydroxyalkyl cellulose; see U.S. Pat. No. 4,000,093.

Soil release agents characterised by poly(vinyl ester) hydrophobe segments include graft copolymers of polylvinyl ester), e.g., $C_1$–$C_6$ vinyl esters, preferably poly(vinyl acetate) grafted onto polyalkylene oxide backbones, such as polyethylene oxide backbones (see EP 0 219 048). Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from 25,000 to 55,000. See U.S. Pat. No. 3,959,230 and U.S. Pat. No. 3,893,929.

Another preferred polymeric soil release agent is a polyester with repeat units of ethylene terephthalate units which contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857.

Another preferred polymeric soil release agent is a sulfonated product of a substantially linear ester oligomer comprising an oligomeric ester backbone of terephthaloyl and oxyalkyleneoxy repeat units and terminal moieties covalently attached to the backbone. These soil release agents are described in U.S. Pat. No. 4,968,451. Other suitable polymeric soil release agents include the terephthalate polyesters of U.S. Pat. No. 4,711,730, the anionic end-capped oligomeric esters of U.S. Pat. No. 4,721,580 and the block polyester oligomeric compounds of U.S. Pat. No. 4,702,857.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises one sulfoisophthaloyl unit, 5 terephthaloyl units, oxyethyleneoxy and oxy-1,2-propyleneoxy units in a ratio of from 1.7 to 1.8, and two end-cap units of sodium 2-(2-hydroxyethoxy)-ethanesulfonate. Said soil release agent also comprises from 0.5% to 20%, by weight of the oligomer, of a crystalline-reducing stabilizer, preferably selected from xylene sulfonate, cumene sulfonate, toluene sulfonate and mixtures thereof.

Preferred polymeric soil release agents also include the soil release agents of U.S. Pat. No. 4,877,896, which discloses anionic, especially sulfoaroyl, end-capped terephthalate esters.

If utilized, soil release agents will generally comprise from 0.01% to 10.0%, by weight, of the compositions herein, typically from 0.1% to 5%, preferably from 0.2% to 3.0%.

Clay Soil Removal/Anti-redeposition Agents

Granular detergent compositions which contain these compounds typically contain from 0.01% to 10.0% by weight of the water-soluble ethoxylates amines; liquid detergent compositions typically contain 0.01% to 5%.

The most preferred soil release and anti-redeposition agent is ethoxylated tetraethylenepentamine. Exemplary ethoxylated amines are further described in U.S. Pat. No. 4,597,898. Another group of preferred clay soil removal-antiredeposition agents are the cationic compounds disclosed in EP 111,965. Other clay soil removal/antiredeposition agents which can be used include the ethoxylated amine polymers disclosed in EP 111,984; the zwitterionic polymers disclosed in EP 112,592; and the amine oxides disclosed in U.S. Pat. No. 4,548,744 and the carboxy methyl cellulose (CMC) materials. These materials are well known in the art.

Dye Transfer Inhibiting Agents

Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from 0.01% to 10% by weight of the composition, preferably from 0.01% to 5%, and more preferably from 0.05% to 2%.

Brighteners

The detergent compositions herein may also optionally contain from 0.005% to 5% by weight of certain types of hydrophilic optical brighteners which also provide a dye transfer inhibition action. If used, the compositions herein will preferably comprise from 0.01% to 1.2% by weight of such optical brighteners.

The hydrophilic optical brighteners useful in the present invention are those having the structural formula:

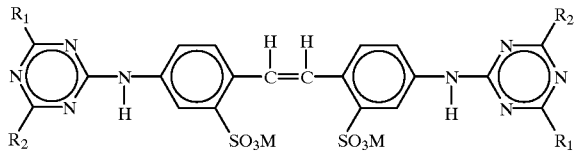

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Conventional optical brighteners or other brightening or whitening agents known in the art can be incorporated at levels typically from 0.005% to 5%, preferably from 0.01% to 1.2% and most preferably from 0.05% to 1.2%, by weight, into the detergent compositions herein. Commercial optical brighteners which may be useful can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982). Further optical brightener which may also be used include naphthalimide, benzoxazole, benzofuran, benzimidazole and any mixtures thereof.

Fabric Softeners

Various through-the-wash fabric softeners, especially the impalpable smectite clays of U.S. Pat. No. 4,062,647, as well as other softener clays known in the art, can optionally be used typically at levels of from 0.5% to 10%, preferably from 0.5% to 2% by weight in the present compositions to provide fabric softener benefits concurrently with fabric cleaning. Clay softeners can be used in combination with amine and cationic softeners as disclosed, for example, in U.S. Pat. No. 4,375,416 and U.S. Pat. No. 4,291,071.

Other Ingredients

A wide variety of other functional ingredients useful in detergent compositions can be included in the compositions herein, including other active ingredients, carriers, hydrotropes, processing aids, dyes or pigments, solvents for liquid formulations, solid fillers for bar compositions. The detergent compositions herein will preferably be formulated such that, during use in aqueous cleaning operations, the wash water will have a pH of between 6.5 and 11, preferably between 7.5 and 10.5. Techniques for controlling pH at recommended usage levels include the use of buffers, alkalis, acids, etc., and are well known to those skilled in the art.

Other Optional Ingredients

Other optional ingredients suitable for inclusion in the compositions of the invention include colours and filler salts, with sodium sulfate being a preferred filler salt.

Form of the Compositions

The detergent compositions of the invention can be formulated in any desirable form such as powders, granulates, pastes, liquids, and gels. Preferably, the detergent composition of the invention is in granular form.

Gel Compositions

The detergent compositions of the present invention may also be in the form of gels. Such compositions are typically formulated with polyakenyl polyether having a molecular weight of from 750,000 to 4,000,000.

Solid Compositions

The detergent compositions of the invention may also be in the form of solids, such as powders and granules.

Preferably, the mean particle size of the components of granular compositions should be such that no more than 5% of particles are greater than 1.4mm in diameter and not more than 5% of particles are less than 0.15mm in diameter.

The term "mean particle size" as defined herein is determined by sieving a sample of the composition into a number of fractions (typically 5 fractions) on a series of Tyler sieves. The weight fractions thereby obtained are plotted against the aperture size of the sieves. The mean particle size is taken to be the aperture size through which 50% by weight of the sample would pass.

The bulk density of granular detergent compositions in accordance with the present invention is particularly useful in concentrated granular detergent compositions that are characterised by a relatively high density in comparison with conventional laundry detergent compositions. Such high density compositions typically have a bulk density of at least 400 g/litre, more preferably from 650 g/litre to 1200 g/litre, most preferably from 800 g/litre to 1000 g/litre.

Making Processes—Granular Compositions

In general, granular detergent compositions in accordance with the present invention can be made via a variety of methods including dry mixing, spray drying, agglomeration and granulation.

The invention is illustrated in the following non-limiting examples, in which all percentages are on a weight basis unless otherwise stated.

In the detergent compositions of the invention, the abbreviated component identifications have the following meanings:

| | |
|---|---|
| XYAS | Sodium $C_{1X}$–$C_{1Y}$ alkyl sulfate |
| XYEZ | A $C_{1x-1y}$ predominantly linear primary alcohol condensed with an average of Z moles of ethylene oxide |

-continued

| | |
|---|---|
| XYEZS | $C_{1X}$–$C_{1Y}$ sodium alkyl sulphate condensed with an average of Z moles of ethylene oxide per mole |
| TFAA | $C_{16}$–$C_{18}$ alkyl N-methyl glucamide |
| CEQ | $R_1COOCH_2CH_2.N^+(CH_3)_3$ with $R_1 = C_{11}$–$C_{13}$ |
| QAS | $R_2.N^+(CH_3)_2(C_2H_4OH)$ with $R_2 = C_{12}$–$C_{14}$ |
| LAS | Sodium linear $C_{12}$ alkyl benzene sulphonate |
| TAS | Sodium tallow alcohol sulphate |
| Soap | Sodium linear alkyl carboxylate derived from an 8O/20 mixture of tallow and a coconut oils. |
| STPP | Anhydrous sodium tripolyphosphate |
| Zeolite A | Hydrated Sodium Aluminosilicate of formula $Na_{12}(A10_2SiO_2)_{12}.27H_2O$ having a primary particle size in the range from 0.1 to 10 micrometers |
| NaSKS-6 | Crystalline layered silicate of formula $\delta$-$Na_2Si_2O_5$ |
| Carbonate | Anhydrous sodium carbonate with a particle size between 200 $\mu$m and 900 $\mu$m |
| Silicate | Amorphous Sodium Silicate ($SiO_2$:$Na_2O$; 2.0 ratio) |
| Sulphate | Anhydrous sodium sulphate |
| Citrate | Tri-sodium citrate dihydrate of activity 86.4% with a particle size distribution between 425 $\mu$m and 850 $\mu$m |
| MA/AA | Copolymer of 1:4 maleic/acrylic acid, average molecular weight about 70,000. |
| CMC | Sodium carboxymethyl cellulose |
| Savinase | Proteolytic enzyme of activity 4KNPU/g |
| Carezyme | Cellulytic enzyme of activity 1000 CEVU/g |
| Termamyl | Amylolytic enzyme of activity 60KNU/g |
| Lipolase | Lipolytic enzyme of activity 100kLU/g all sold by NOVO Industries A/S and of activity mentioned above unless otherwise specified |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium Percarbonate of nominal formula $2Na_2CO_3.3H_2O_2$ |
| TAED | Tetraacetyl ethylene diamine |
| NACA-OBS | (6-nonanamidocaproyl)oxy benzene sulfonate |
| NOBS | Nonanoyloxybenzene sulfonate in the form of the sodium salt |
| DTPMP | Diethylene triamine penta (methylene phosphonate), marketed by Monsanto under the Trade name Dequest 2060 |
| Photoactivated | Sulphonated Zinc Phthalocyanin encapsulated in bleach dextrin soluble polymer |
| Brightener 1 | Disodium 4,4'-bis(2-sulphostyryl)biphenyl |
| Brightener 2 | Disodium 4,4'-bis(4-anilino-6-morpholino-1,3,5-triazin-2-yl)amino) stilbene-2:2'-disulphonate. |
| HEDP | 1,1-hydroxyethane diphosphonic acid |
| STS | Sodium toluene sulfonate |
| SRP | Sulfobenzoyl end capped esters with oxyethylene oxy and terephtaloyl backbone |
| Silicone antifoam | Polydimethyldiloxane foam controller with Siloxane-oxyalkylene copolymer as dispersing agent with a ratio of said foam controller to said dispersing agent of 10:1 to 100:1. |

EXAMPLE 1

The following bleach precursor particulates were made:

| Example | 1 | 2 | 3 | 4 | 5 | 6 | 7 | 8 |
|---|---|---|---|---|---|---|---|---|
| NACA-OBS | 65 | 65 | — | — | 65 | 38 | 74.5 | 65 |
| NOBS | — | — | 65 | — | — | — | — | — |
| TAED | — | — | — | 65 | — | 27 | — | — |
| LAS | 9.8 | — | — | 9.8 | 9.8 | 9.8 | 10 | 10 |
| 28AS | — | 9.8 | 9.8 | — | — | — | — | — |
| 24E3 | 0.3 | 0.3 | 0.3 | 0.3 | 0.3 | 0.5 | 0.5 | 0.5 |
| STS | 0.96 | 0.96 | 0.96 | 0.96 | — | 0.9 | 1.0 | 1.0 |

-continued

| Example | 1 | 2 | 3 | 4 | 5 | 6 | 7 | 8 |
|---|---|---|---|---|---|---|---|---|
| citric acid | 11.3 | 11.3 | 11.3 | 11.3 | — | 11.3 | 10 | 10 |
| CMC | 6.2 | 6.2 | 6.2 | 6.2 | — | 6.2 | 2.0 | 10 |
| Water to balance to 100% | | | | | | | | |

In each of examples 1–6, the bleach precursor (i.e. NACA-OBS and/or TAED or NOBS) was premixed with CMC and then water was added, with (example 2 to 7) or without (example 1) nonionic surfactant. The remaining ingredients were added and mixed in a Loedige FM mixer. The premix was then fed into a dome extruder (Fuji Paudal Model DGL-1) having a die with 0.8 mm orifices and extruded at a pressure of about 20 bar. The resulting extrudate was then fed into a rotating disc spheroniser (Fuji Paudal QJ-400) where they were broken down into short lengths and formed into substantially spherical particles. The particles were then dried in a Niro vibrating fluid-bed dryer resulting in crisp, free-flowing dust free particles with a particle size range of from 0.25 mm to 2.00 mm and a Heubach dust measurement of less than 100 mg/g.

The particulate of Examples 1 was taken and coated in a drum mixer with 24E3 surfactant and then further dusted with 1 part of Zeolite in a second drum mixer. The resultant particles remained crisp and free-flowing and showed improved resistance to dust-generation as demonstrated by a reduction in Heubach dust value from 35 mg/g (uncoated) to 12 mg/g.

The particulate of Examples 7 was taken and coated in a drum mixer with 0.4 parts of 24E3 surfactant and then further dusted with 1 part of Zeolite in a second drum mixer. The resultant particles remained crisp and free-flowing and showed improved resistance to dust-generation as demonstrated by a reduction in Heubach dust value from 35 mg/g (uncoated) to 12 mg/g.

The bleach particulate of Example 8 was made by premixing the bleach precursor with CMC and 20 parts of water were added. The mixture was mixed for 5 minutes in a Loedige FM mixer. The remaining ingredients were added and the mixing continued for a further 5 minutes. The resultant wet agglomerate was then passed to a fluid bed drier to remove water to give crisp free flowing particles.

EXAMPLE 2

The following detergent formulations, according to the present invention were prepared, where formulation A is a phosphorus-containing detergent composition, formulation B is a zeolite-containing detergent composition and formulation C is a compact detergent composition:

| | A | B | C |
|---|---|---|---|
| Blown Powder | | | |
| STPP | 24.0 | — | 24.0 |
| Zeolite A | — | 24.0 | — |
| Sulphate | 9.0 | 6.0 | 13.0 |
| MA/AA | 2.0 | 4.0 | 2.0 |
| LAS | 6.0 | 8.0 | 11.0 |
| TAS | 2.0 | — | — |
| Silicate | 7.0 | 3.0 | 3.0 |
| CMC | 1.0 | 1.0 | 0.5 |
| Brightener 2 | 0.2 | 0.2 | 0.2 |

-continued

| | A | B | C |
|---|---|---|---|
| Soap | 1.0 | 1.0 | 1.0 |
| DTPMP | 0.4 | 0.4 | 0.2 |
| Spray On | | | |
| C45E7 | 2.5 | 2.5 | 2.0 |
| C25E3 | 2.5 | 2.5 | 2.0 |
| Silicone antifoam | 0.3 | 0.3 | 0.3 |
| Perfume | 0.3 | 0.3 | 0.3 |
| Dry additives | | | |
| Carbonate | 6.0 | 13.0 | 15.0 |
| PB4 | 18.0 | 18.0 | 10 |
| PB1 | 4.0 | 4.0 | — |
| Bleach precursor particulate(*) | 3.0 | 3.0 | 1.0 |
| Photoactivated bleach | 0.02% | 0.02% | 0.02% |
| Savinase | 1.0 | 1.0 | 1.0 |
| Lipolase | 0.4 | 0.4 | 0.4 |
| Termamyl | 0.25 | 0.30 | 0.15 |
| Sulphate | 3.0 | 3.0 | 5.0 |
| Balance (Moisture and Miscellaneous) to 100 | | | |
| Density (g/liter) | 630 | 670 | 670 |

(*)Bleach precursor particulate as made in any one of examples 1–8

EXAMPLE 3

The following detergent formulations D to E, according to the present invention were prepared:

| | D | E |
|---|---|---|
| LAS | 20.0 | 14.0 |
| QAS | 0.7 | 1.0 |
| TFAA | — | 1.0 |
| C25E5/C45E7 | — | 2.0 |
| C45E3S | — | 2.5 |
| STPP | 30.0 | 18.0 |
| Silicate | 9.0 | 5.0 |
| Carbonate | 13.0 | 7.5 |
| Bicarbonate | — | 7.5 |
| DTPMP | 0.7 | 1.0 |
| SRP 1 | 0.3 | 0.2 |
| MA/AA | 2.0 | 1.5 |
| CMC | 0.8 | 0.4 |
| Savinase | 0.8 | 1.0 |
| Termamyl | 0.8 | 0.4 |
| Lipolase | 0.2 | 0.1 |
| Carezyme (5T) | 0.15 | 0.05 |
| Photoactivated bleach (ppm) | 70 ppm | 45 ppm |
| Brightener 1 | 0.2 | 0.2 |
| PB1 | 6.0 | 2.0 |
| Bleach precursor particulate(*) | 2.0 | 1.0 |
| Balance (Moisture and Miscellaneous) to 100 | | |

(*)Bleach precursor particulate as made in any one of examples 1–8

EXAMPLE 4

The following detergent formulations F to H, according to the present invention were prepared:

| | F | G | H |
|---|---|---|---|
| Blown Powder | | | |
| Zeolite A | 30.0 | 22.0 | 6.0 |
| Sulphate | 19.0 | 10.0 | 7.0 |

-continued

| | F | G | H |
|---|---|---|---|
| MA/AA | 3.0 | 3.0 | 6.0 |
| LAS | 14.0 | 12.0 | 22.0 |
| C45AS | 8.0 | 7.0 | 7.0 |
| Silicate | — | 1.0 | 5.0 |
| Soap | — | — | 2.0 |
| Brightener 1 | 0.2 | 0.2 | 0.2 |
| Carbonate | 8.0 | 16.0 | 20.0 |
| DTPMP | — | 0.4 | 0.4 |
| Spray On | | | |
| C45E7 | 1.0 | 1.0 | 1.0 |
| Dry additives | | | |
| PVPVI/PVNO | 0.5 | 0.5 | 0.5 |
| Savinase | 1.0 | 1.0 | 1.0 |
| Lipolase | 0.4 | 0.4 | 0.4 |
| Termamyl | 0.1 | 0.1 | 0.1 |
| Carezyme | 0.1 | 0.1 | 0.1 |
| Bleach precursor particulate(*) | — | 6.1 | 4.5 |
| PB1 | 1.0 | 5.0 | 6.0 |
| Sulphate | — | 6.0 | — |
| Balance (Moisture and Miscellaneous) to 100 | | | |

(*)Bleach precursor particulate as made in any one of examples 1–8

EXAMPLE 5

The following high density and bleach-containing detergent formulations I to K, according to the present invention were prepared:

| | I | J | K |
|---|---|---|---|
| Blown Powder | | | |
| Zeolite A | 15.0 | 15.0 | 15.0 |
| Sulphate | — | 5.0 | — |
| LAS | 3.0 | 3.0 | 3.0 |
| QAS | — | 1.5 | 1.5 |
| DTPMP | 0.4 | 0.4 | 0.4 |
| CMC | 0.4 | 0.4 | 0.4 |
| MA/AA | 4.0 | 2.0 | 2.0 |
| Agglomerates | | | |
| LAS | 5.0 | 5.0 | 5.0 |
| TAS | 2.0 | 2.0 | 2.0 |
| Silicate | 3.0 | 3.0 | 4.0 |
| Zeolite A | 8.0 | 8.0 | 8.0 |
| Carbonate | 8.0 | 8.0 | 4.0 |
| Spray On | | | |
| Perfume | 0.3 | 0.3 | 0.3 |
| C45E7 | 2.0 | 2.0 | 2.0 |
| C25E3 | 2.0 | — | — |
| Dry additives | | | |
| Citrate | 5.0 | — | 2.0 |
| Bicarbonate | — | 3.0 | — |
| Carbonate | 8.0 | 15.0 | 10.0 |
| Bleach precursor particulate(*) | 6.0 | 2.0 | 5.0 |
| PB1 | 14.0 | 7.0 | 10.0 |
| Polyethylene oxide of MW 5,000,000 | — | — | 0.2 |
| Bentonite | — | — | 10.0 |
| Savinase | 1.0 | 1.0 | 1.0 |
| Lipolase | 0.4 | 0.4 | 0.4 |
| Termamyl | 0.6 | 0.6 | 0.6 |
| Carezyme | 0.6 | 0.6 | 0.6 |
| Silicone antifoam granule | 5.0 | 5.0 | 5.0 |

-continued

| | I | J | K |
|---|---|---|---|
| Dry additives | | | |
| Sulphate | — | 3.0 | — |
| Balance (Moisture and Miscellaneous) to 100 | | | |
| Density (g/liter) | 850 | 850 | 850 |

(*)Bleach precursor particulate as made in any one of examples 1–8

EXAMPLE 6

The following high density detergent formulations L and M, according to the present invention were prepared:

| | L | M |
|---|---|---|
| Agglomerate | | |
| C45AS | 11.0 | 14.0 |
| Zeolite A | 15.0 | 6.0 |
| Carbonate | 4.0 | 8.0 |
| MA/AA | 4.0 | 2.0 |
| CMC | 0.5 | 0.5 |
| DTPMP | 0.4 | 0.4 |
| Spray On | | |
| C25E5 | 5.0 | 5.0 |
| Perfume | 0.5 | 0.5 |
| Dry Additives | | |
| HEDP | 0.5 | 0.3 |
| SKS 6 | 13.0 | 10.0 |
| Citrate | 3.0 | 1.0 |
| Bleach precursor particulate(*) | 5.0 | 7.0 |
| PC | 20.0 | 20.0 |
| SRP 1 | 0.3 | 0.3 |
| Savinase | 1.4 | 1.4 |
| Lipolase | 0.4 | 0.4 |
| Carezyme | 0.6 | 0.6 |
| Termamyl | 0.6 | 0.6 |
| Silicone antifoam particle | 5.0 | 5.0 |
| Brightener 1 | 0.2 | 0.2 |
| Brightener 2 | 0.2 | — |
| Balance (Moisture and Miscellaneous) to 100 | | |
| Density (g/liter) | 850 | 850 |

(*)Bleach precursor particulate as made in any one of examples 1–8

EXAMPLE 7

The following laundry detergent compositions N to O were prepared in accord with the invention:

| | N | O |
|---|---|---|
| LAS | 8.0 | 8.0 |
| C25E3 | 3.4 | 3.4 |
| CEQ | 0.8 | — |
| QAS | — | 0.8 |
| Zeolite A | 18.1 | 18.1 |
| Carbonate | 13.0 | 13.0 |
| Silicate | 1.4 | 1.4 |
| Sulfate | 26.1 | 26.1 |
| PB4 | 9.0 | 9.0 |
| Bleach precursor particulate(*) | 1.5. | 1.5 |
| DTPMP | 0.25 | 0.25 |
| HEDP | 0.3 | 0.3 |
| Protease | 0.26 | 0.26 |
| Amylase | 0.1 | 0.1 |
| MA/AA | 0.3 | 0.3 |

-continued

| | N | O |
|---|---|---|
| CMC | 0.2 | 0.2 |
| Photoactivated bleach (ppm) | 15 ppm | 15 ppm |
| Brightener 1 | 0.09 | 0.09 |
| Perfume | 0.3 | 0.3 |
| Silicone antifoam | 0.5 | 0.5 |
| Misc/minors to 100% | | |
| Density in g/liter | 850 | 850 |

(*)Bleach precursor particulate as made in any one of examples 1–8

What is claimed is:

1. A solid bleach precursor composition comprising:

(a) a bleach precursor selected from the group consisting of nonanoyl oxy benzene sulfonate, (6-octanamido-caproyl)oxybenzenesulfonate, (6-nonanamidocaproyl) oxy benzene sulfonate, (6-decanamido-caproyl) oxybenzenesulfonate, and mixtures thereof;

(b) a surfactant system comprising a non-ethoxylated anionic surfactant component and a nonionic surfactant component; and (c) from 0.1% to 20% by weight of the composition of a hydrotrope selected from the group consisting of salts of cumene sulfonate, xylene sulfonate, toluene sulfonate and mixtures thereof;

wherein the physical form of said composition is selected from the group consisting of forms wherein:

(i) a bleach precursor particulate is coated with one or more layers wherein at least one layer contains one of said surfactant system components and the other of said surfactant system components is in intimate admixture with said bleach precursor;

(ii) a bleach precursor particulate comprises one of the surfactant system components, and is coated with one or more layers wherein at least one layer contains said bleach precursor in intimate admixture with the other surfactant system component;

(iii) a bleach precursor particulate is coated with either one or more layers, wherein at least one layer contains both components of said surfactant system, or with at least two layers wherein at least one layer contains one of said surfactant system components and at least another layer contains the other said surfactant system components; and (iv) both of said surfactant system components are coated with one or more layers wherein at least one layer contains said bleach precursor;

said solid bleach precursor composition being further dusted with zeolite.

2. A composition according to claim 1, wherein said surfactant system is present in amount of 0.1% to 50% by weight of the bleach precursor composition.

3. A composition according to claim 1, wherein said bleach precursor is present in an amount of 10% to 99% by weight of the bleach precursor composition.

4. A composition according to claim 1, wherein said anionic surfactant is selected from the group consisting of sulfate surfactants, sulfonate surfactants, carboxylate surfactants, sarcosinate surfactants and mixtures thereof.

5. A composition according to claim 4, wherein said anionic surfactant is the salt of $C_5$–$C_{20}$ linear alkylbenzene sulfonate.

6. A composition according to claim 1, wherein said nonionic surfactant is selected from the group consisting of ethoxylated alcohol surfactants, ethoxylated/propoxylated fatty alcohol surfactant, ethylene oxide/propylene oxide condensates with propylene glycol, ethylene oxide condensation products with propylene oxide/ethylene diamine adducts and mixtures thereof.

7. A composition according to claim 6, wherein said nonionic surfactant is the condensation product of alcohol having an alkyl group containing from about 8 to about 20 carbon atoms with from about 2 to about 10 moles of ethylene oxide per mole of alcohol.

8. A granular detergent composition comprising a solid bleach precursor composition according to claim 1 and a source of hydrogen peroxide.

* * * * *